US006051125A

United States Patent [19]

Pham et al.

[11] Patent Number: 6,051,125

[45] Date of Patent: Apr. 18, 2000

[54] NATURAL GAS-ASSISTED STEAM ELECTROLYZER

[75] Inventors: Ai-Quoc Pham, San Jose; P. Henrik Wallman, Berkeley; Robert S. Glass, Livermore, all of Calif.

[73] Assignee: The Regents of the University of California, Oakland, Calif.

[21] Appl. No.: 09/157,687

[22] Filed: Sep. 21, 1998

[51] Int. Cl.[7] ..... C25B 1/02

[52] U.S. Cl. ..... 205/637; 204/252; 204/274; 204/277

[58] Field of Search ..... 205/637; 204/252, 204/274, 277

[56] References Cited

U.S. PATENT DOCUMENTS

| | | | |
|---|---|---|---|
| 3,446,674 | 5/1969 | Giner | 136/86 |
| 3,755,131 | 8/1973 | Shalit | 204/246 |
| 5,312,843 | 5/1994 | Yamauchi et al. | 204/129 |

*Primary Examiner*—Kishor Mayekar

*Attorney, Agent, or Firm*—L. E. Carnahan

[57] ABSTRACT

An efficient method of producing hydrogen by high temperature steam electrolysis that will lower the electricity consumption to an estimated 65 percent lower than has been achievable with previous steam electrolyzer systems. This is accomplished with a natural gas-assisted steam electrolyzer, which significantly reduces the electricity consumption. Since this natural gas-assisted steam electrolyzer replaces one unit of electrical energy by one unit of energy content in natural gas at one-quarter the cost, the hydrogen production cost will be significantly reduced. Also, it is possible to vary the ratio between the electricity and the natural gas supplied to the system in response to fluctuations in relative prices for these two energy sources. In one approach an appropriate catalyst on the anode side of the electrolyzer will promote the partial oxidation of natural gas to CO and hydrogen, called Syn-Gas, and the CO can also be shifted to $CO_2$ to give additional hydrogen. In another approach the natural gas is used in the anode side of the electrolyzer to burn out the oxygen resulting from electrolysis, thus reducing or eliminating the potential difference across the electrolyzer membrane.

19 Claims, 3 Drawing Sheets

NATURAL GAS-ASSISTED STEAM ELECTROLYZER

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to hydrogen production, particularly to hydrogen production by high temperature steam electrolysis, and more particularly to natural gas-assisted high temperature steam electrolyzers that will lower the electricity consumption to at least an estimated 35 percent of conventional steam electrolyzers.

Hydrogen is a reactant in many industrial processes and is envisaged to become even more important in the future as a chemical reactant, as well as a premium fuel. Presently, most of the total hydrogen demand is met by hydrogen production from fossil fuels; i.e., by steam reforming of natural gas and by coal gasification. Hydrogen produced from water electrolysis is much simpler and has no adverse localized environmental consequences. However, up to the present time, water electrolysis has no significant commercial application because the process requires the use of large amounts of electricity, which results in a high production cost.

From the thermodynamic viewpoint, it is more advantageous to electrolyze water at high temperature (800° C. to 1000° C.) because the energy is supplied in mixed form of electricity and heat. See W. Donitz et al., *"High Temperature Electrolysis of Water Vapor-Status of Development and Perspective for Application," Int. J. Hydrogen Energy* 10,291 (1985). In addition, the high temperature accelerates the reaction kinetics, reducing the energy loss due to electrode polarization and increasing the overall system efficiency. Typical high temperature electrolyzers, such as the German Hot Elly system, achieved 92 percent electrical efficiency while low temperature electrolyzers can reach at most 85 percent efficiency. See above-referenced W. Donitz et al. Despite the high efficiency, the German system still produces hydrogen at about twice the cost of the steam reformed hydrogen. To promote widespread on-site production of the electrolytic hydrogen, the hydrogen production cost must be lowered. According to the German analysis of the Hot Elly system, about 80 percent of the total hydrogen production cost can be attributed to the cost of electricity needed to run the system. Therefore, to make electrolysis competitive with steam-reformed hydrogen, the electricity consumption of the electrolyzer must be reduced to at least 50 percent for any current system. However, there is no obvious solution to this problem because high electricity consumption is mandated by thermodynamic requirements for the decomposition of water.

The present invention provides a solution to the above-mentioned high electricity consumption in high temperature steam electrolyzers. The invention provides an approach to high temperature steam electrolysis that will lower the electricity consumption to at least 65 percent lower than has been achieved with previous steam electrolyzer systems. The invention involves a natural gas-assisted steam electrolyzer for hydrogen production. The resulting hydrogen production cost is expected to be competitive with the steam-reforming process. Because of its modular characteristics, the system of the present invention provides a solution to distributed hydrogen production for local hydrogen refueling stations, home appliances, and on-board hydrogen generators.

SUMMARY OF THE INVENTION

It is an object of the present invention to efficiently produce hydrogen by high temperature steam electrolysis.

A further object of the invention is to provide a hydrogen producing high temperature steam electrolyzer that will lower the electricity consumption by at least 50 to 90 percent relative to current steam electrolyzers.

A further object of the invention is to provide a natural gas-assisted steam electrolyzer.

Another object of the invention is to provide a process for producing hydrogen by natural gas-assisted steam electrolysis wherein the production cost is competitive with the steam-reforming hydrogen producing process.

Another object of the invention is to provide a high-temperature steam electrolysis system for large-scale hydrogen production, as well as local hydrogen refueling stations, home appliances, transportation, and on-board hydrogen generators.

Another object of the invention is to provide a natural gas-assisted steam electrolyzer for efficient hydrogen production and simultaneous production of Syn-Gas ($CO+H_2$) useful for chemical syntheses.

Another object of the invention is to provide a natural gas-assisted steam electrolyzer as a high efficiency source for clean energy fuel.

Another object of the invention is to provide a natural gas-assisted high temperature steam electrolyzer for promoting the partial oxidation of natural gas to CO and hydrogen (i.e., produce Syn-Gas), and wherein the CO can also be shifted to $CO_2$ to yield additional hydrogen.

Another object of the invention is to provide a natural gas-assisted high temperature steam electrolyzer wherein the natural gas is utilized to burn out the oxygen resulting from electrolysis on the anode side, thereby reducing or eliminating the electrical potential difference across the electrolyzer membrane.

Other objects and advantages of the present invention will become apparent from the following description and accompanying drawings. Basically, the invention involves a natural gas-assisted steam electrolyzer for efficiently producing hydrogen. The high temperature steam electrolyzer of the present invention will lower electricity consumption, compared to currently known steam electrolyzers by at least 65 percent. In particular, the electricity consumption of the natural gas-assisted steam electrolyzer is 65 percent lower than that achieved with the above-referenced German Hot Elly system, which is known to be the most advanced high temperature stream electrolyzer designed to date. Since it has been estimated that about 80 percent of the total hydrogen production cost comes from the cost of electricity used, a reduction of 65 percent in electricity usage results in a significantly lower overall production cost. Since natural gas is about one-quarter the cost of electricity (in the United States), it is additionally obvious that the hydrogen production cost will be greatly lowered. In one approach of the invention, by use of an appropriate catalyst (Ni cermet) on the anode side of the electrolyzer, partial oxidation of natural gas to CO and hydrogen will be produced (a gas mixture known as Syn-Gas), and the CO can also be shifted to $CO_2$ to give additional hydrogen. In this approach, hydrogen is produced on both sides of the steam electrolyzer. In yet another approach of the invention, natural gas is used in the anode side of the electrolyzer to burn out the oxygen resulting from electrolysis on the anode side, thereby reducing or eliminating the potential difference across the electrolyzer membrane. This latter approach replaces one unit of electrical energy by one unit of energy content in natural gas at one-quarter the cost, thus reducing the overall hydrogen production cost.

BRIEF DESCRIPTION OF THE DRAWINGS

The accompanying drawings, which are incorporated into and form a part of the disclosure, illustrate embodiments of the invention and, together with the description, serve to explain the principles of the invention.

DETAILED DESCRIPTION OF THE INVENTION

Figure 1:
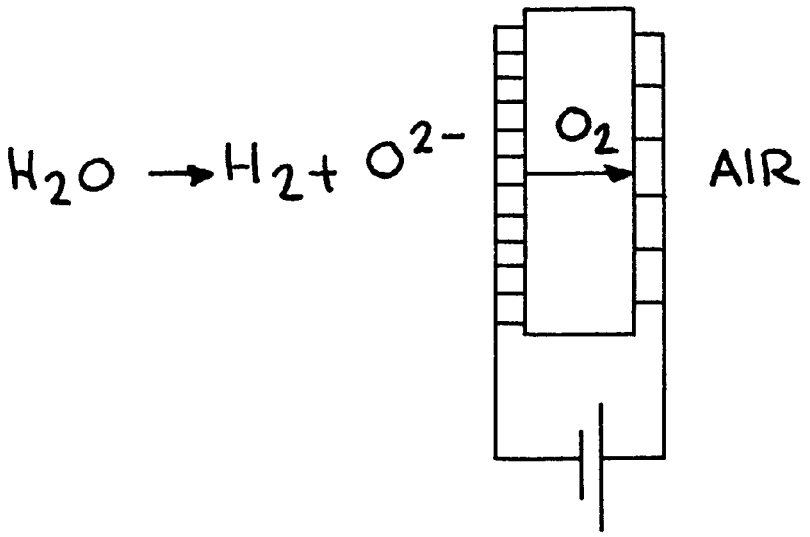
FIG. 1 (PRIOR ART)
FIG. 1 schematically illustrates a conventional high-temperature steam electrolyzer.

The present invention is directed to a natural gas-assisted high temperature steam electrolyzer for producing hydrogen. The novel approach to high temperature steam electrolysis provided by the present invention will lower the electricity consumption for hydrogen production by at least an estimated 65 percent relative to that which has been achievable with previous steam electrolyzer systems. The resulting hydrogen product cost will then be competitive with conventional steam-reforming processes. Because of the modular characteristics of the steam electrolyzer of the present invention, it can be utilized for large scale hydrogen production for industrial plants, for hydrogen refueling stations, or for smaller systems for home use, transportation, etc. In addition, the steam electrolyzer of the present invention can be utilized to produce Syn-Gas, which is useful for chemical synthesis. Also, the natural gas-assisted steam electrolyzer of the present invention is a high efficiency source for a clean energy fuel: namely, hydrogen.

As pointed out above, from a thermodynamic viewpoint, it is more advantageous to electrolyze water at high temperature (800° C. to 1000° C.) because the energy is supplied in mixed form of electricity and heat. In addition, the high temperature accelerates the reaction kinetics, reducing the energy loss due to electrode polarization and increasing the overall system efficiency.

The thermodynamics require that a minimum amount of energy needs to be supplied in order to break down water molecules. Up to now, this energy is supplied as electricity for low temperature water electrolyzers and as electricity and heat for high temperature (800° C. to 1000° C.) steam electrolyzers. The approach used in the present invention is to reduce energy losses by introducing natural gas on the anode side of the electrolyzer. Since natural gas is about one-quarter the cost of electricity, by replacing one unit of electrical energy by one unit of chemical energy stored in natural gas, the hydrogen production cost will be lowered.

The present invention combines four known phenomena in one device:

1. Solid oxide membranes can separate oxygen from any gas mixture by only allowing oxygen to penetrate the membrane (in the form of oxygen ions).

2. Creation of oxygen ions from molecular oxygen (or oxygen containing compounds such as water) at one side of the membrane (cathode) and recreation of molecular oxygen at the other side (anode) can be accomplished by including both a catalytic and a conductive material on both sides of the membrane, and connecting the cathode to the negative pole and the anode to the positive pole of a DC power supply.

3. The cathode catalyst and the DC voltage can be selected so as to decompose water supplied to the cathode in the form of steam to molecular hydrogen and oxygen ions.

4. Removing the molecular oxygen from the anode surface by reaction (with hydrocarbons, for example), lowers the oxygen chemical potential of the anode thus lowering necessary voltage for achieving water decomposition at the cathode by lowering the over-potential for pumping oxygen ions through the membrane.

In addition to combining phenomena 1–4, one embodiment of the invention prescribes the use of a partial oxidation anode catalyst together with natural gas, resulting in $H_2$+CO (Syn-Gas) production at the anode. This embodiment hence provides for hydrogen production at both sides of the membrane with the synergism of much-reduced electricity consumption. A further embodiment prescribes the addition of a CO-to-$CO_2$ shift converter (known technology) resulting in even more production of hydrogen ($CO+H_2O \rightarrow H_2+CO_2$). This addition also has the synergistic effect of producing heat for steam production necessary for the cathode feed.

In previous steam electrolyzers, such as the above-referenced German Hot Elly, the cathode gas, located on one side of the electrolyzer membrane, is usually a mixture of steam (as the result of heating the water to produce steam) and hydrogen, because of the reaction $H_2O \rightarrow H_2+O^{2-}$ at the cathode surface. The anode gas, located on the opposite side of the electrolyzer membrane, is usually air, as displayed in FIG. 1. At zero current, the system has an open circuit voltage of about 0.9 V, depending on the hydrogen/steam ratio and on the temperature. In order to electrolyze water, a voltage higher than the open circuit voltage must be applied to pump oxygen from the steam (cathode) side to the air (anode) side. Clearly, much of the electricity, or 60 to 70 percent of the total electricity, is wasted in forcing the electrolyzer to operate against the high chemical potential gradient, as graphically illustrated in FIG. 2. If a reducing gas, such as natural gas, is used at the anode side instead of air, the chemical potential gradient across the electrolyzer can be reduced close to zero or even a negative value; therefore, oxygen can more easily be pumped from the cathode side to the anode side (at lower electrical energy consumption) or the situation may even become spontaneous for splitting of water.

Figure 2:
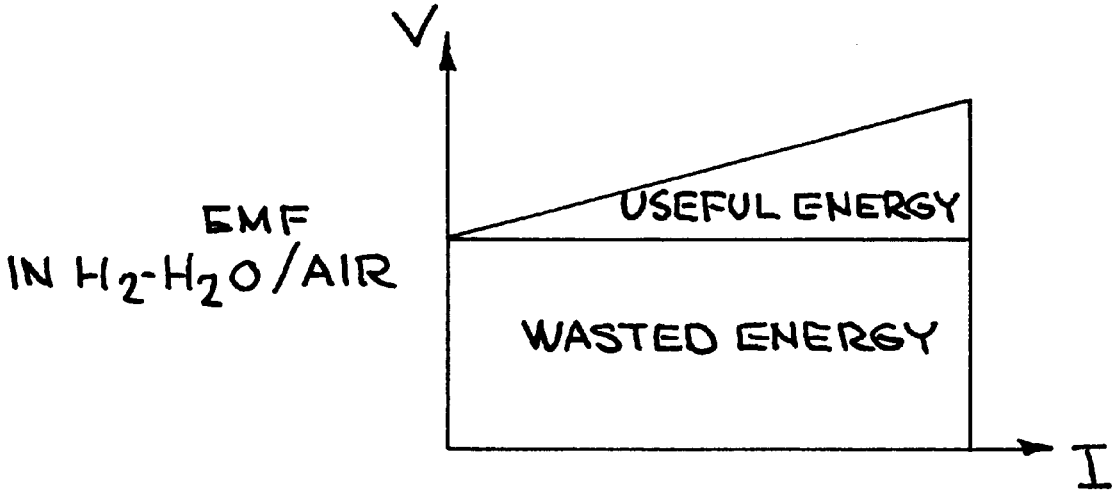
FIG. 2 (PRIOR ART)
FIG. 2 graphically illustrates the energy consumption characteristic of the system shown in FIG. 1 represented in terms of current-voltage curve.

Pursuant to the present invention wherein a natural gas-assisted steam electrolyzer is utilized, 60 to 70 percent of the electrical energy of the conventional system of FIGS. 1 and 2 is significantly reduced. Two approaches of the present invention are illustrated in FIGS. 3–4 and in FIGS. 5–6, and are described in detail hereinafter.

Figure 3:
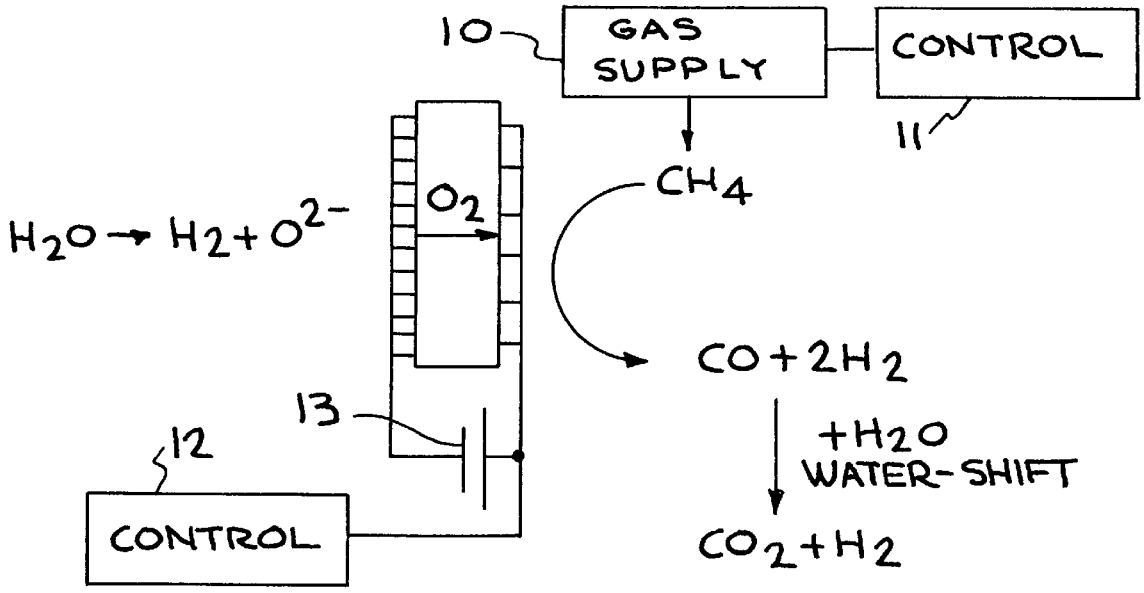
FIG. 3 schematically illustrates an approach or embodiment of a natural gas-assisted steam electrolyzer made in accordance with the present invention which involves partial oxidation of the natural gas.
Figure 4:
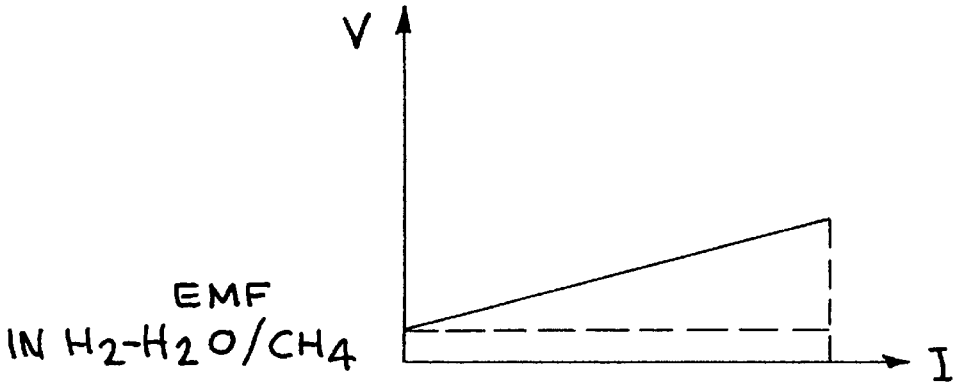
FIG. 4 graphically illustrates the energy consumption of the FIG. 3 embodiment, with a significant reduction in open-circuit voltage.

In the first approach shown by FIGS. 3–4 embodiment, an appropriate catalyst, such as an Ni cermet, on the anode side of the electrolyzer, will promote the partial oxidation of natural gas ($CH_4$) to CO and hydrogen by means of molecular oxygen evolving from the anode. The resulting gas mixture ($CO+2H_2$), also known as Syn-Gas, can be used in important industrial processes, such as the synthesis of methanol and liquid fuels. The CO can also be shifted to $CO_2$ to yield additional hydrogen by conventional processing. In this process, hydrogen is produced at both sides of the steam electrolyzer. The overall reaction is equivalent to the steam reforming of natural gas. In the steam reforming process, the heat necessary for the endothermic reaction is provided by burning part of the natural gas. The use of electricity in the electrolyzer approach with almost 100 percent current efficiency is expected to yield an overall system efficiency close to 90 percent while that of the steam reforming process is 65 to 75 percent. When compared to a conventional electrolyzer, the same amount of electric current in the approach shown in FIGS. 3–4 will produce four times more hydrogen. Moreover, because most of the energy for splitting water is provided by natural gas, the electricity consumption is very low, and it is estimated to be 0.3 $kWh/m^3H_2$, about one order of magnitude lower than the amount required in the above-referenced German Hot Elly process. In addition to an Ni cermet as the catalyst, other catalysts may include rhodium and ruthenium. FIG. 4, which shows current voltage characteristics, clearly illustrates the reduction in electrical energy and the increase in useful energy of the FIG. 3 embodiment, when compared to that shown in FIG. 2 for the conventional steam electrolyzer of FIG. 1. FIG. 3 includes a $CH_4$ gas supply 10 and a control therefore indicated at 11, as well as a control 12 for the electric power supply 13.

Depending on the conditions (temperature, hydrogen to steam ratio), the potential on the anode side (natural gas side) may be lower than the potential of the cathode (steam side), in which case, the electrolysis can be spontaneous; no electricity is needed to split water. The system operates in a similar way to a fuel cell. By using a mixed ionic-electronic conductor as electrolyte instead of the conventional pure ionic conductor made of yttria-stabilized-zirconia, no external electrical circuit is required, simplifying considerably the system. The mixed conductor can be made of doped-ceria or of the family (La, Sr)(Co, Fe, Mn) $O_3$.

Figure 5:
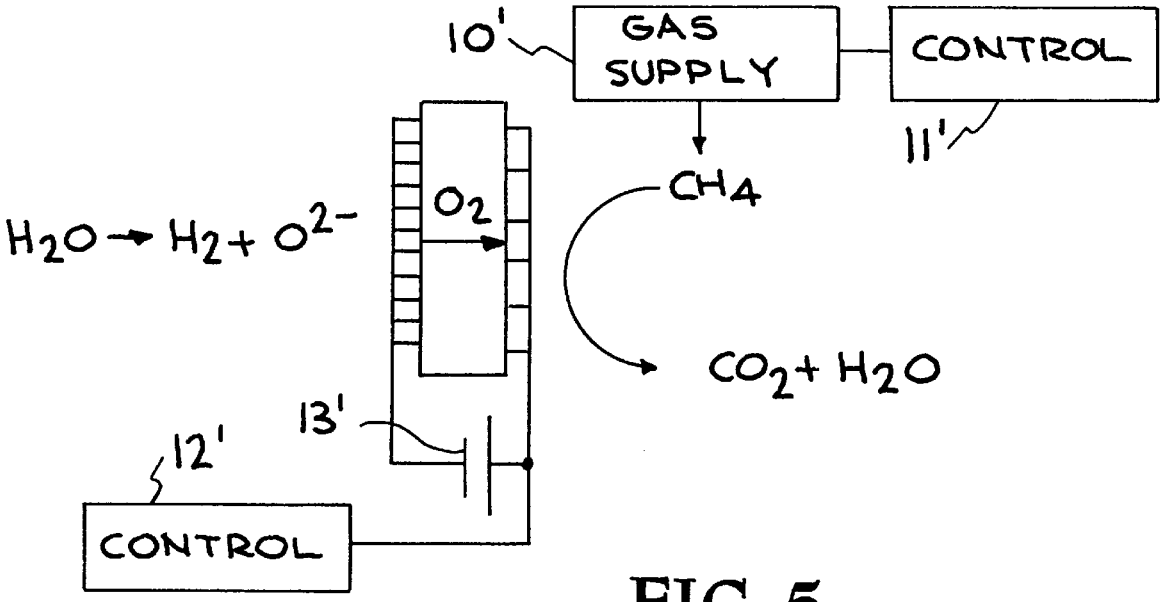
FIG. 5 schematically illustrates another approach or embodiment of the invention which involves total oxidation of the natural gas.
Figure 6:
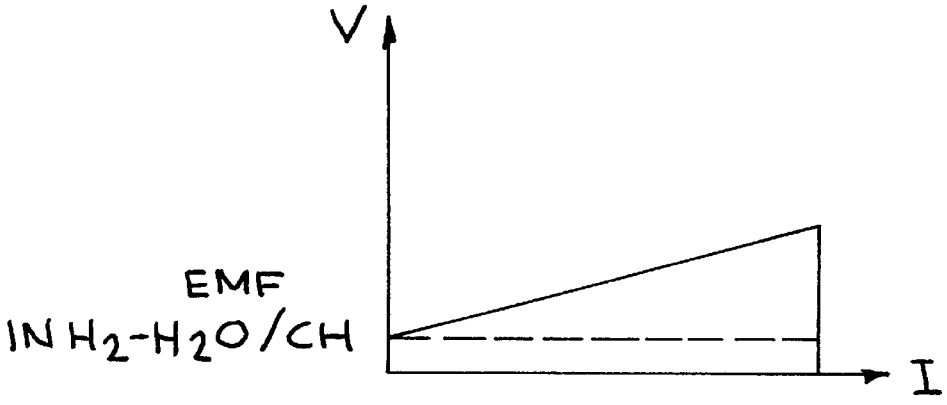
FIG. 6 graphically illustrates the energy consumption of the FIG. 5 embodiment.

In the second approach shown by the FIGS. 5–6 embodiment, natural gas is used in the anode side of the electrolyzer to burn out the oxygen results from the electrolysis at the cathode side, thus reducing or eliminating the potential difference across the electrolyzer membrane. The electricity consumption for this approach will be reduced to about 35 percent of previous systems. The direct use of natural gas instead of electricity to overcome the chemical potential difference will yield an efficiency as high as 60 percent with respect to primary energy, while conventional systems exhibit at best 40 percent efficiency (assuming an average efficiency of 40 percent for the conversion of primary energy to electricity). In addition, because the new process replaces one unit of electrical energy by one unit of energy content in natural gas at one-quarter the cost, the hydrogen production cost will be significantly reduced. In addition, with the FIGS. 5–6 embodiment, via the controls 11' and 12' of the $CH_4$ gas 10' and the electrical supply 13', it is possible to vary the ratio between the electricity input and the natural gas input in response to fluctuations in relative prices for natural gas and electricity. For example, during electricity off-peak hours, the amount of natural gas can be reduced. The gain in useful energy and the reduction in wasted energy of the FIG. 5 embodiment is clearly illustrated by a comparison of FIG. 6 with FIG. 2.

It has thus been shown that the natural gas-assisted high temperature steam electrolyzer of the present invention lowers the electricity consumption to below the necessary 50 percent reduction to make electrolysis competitive with steam reforming for the production of hydrogen; and thus the electricity consumption is 65 percent lower than was achieved with previous steam electrolyzer systems, such as the German Hot Elly system. Since hydrogen can now be produced from water electrolysis, which is a much simpler process than steam reforming of natural gas or by coal gasification, hydrogen production by water electrolysis will become commercially competitive with the other processes and will be viewed as environmentally friendly. Because of its modular characteristics, the systems of the present invention provide a solution to distributed hydrogen production for local hydrogen refueling stations, home appliances, transportation, and on-board hydrogen generators. In addition, the systems of the present invention can be used for large-scale hydrogen and/or Syn-Gas production for industrial plants or for chemical synthesis, as well as a high efficiency source for a clean energy fuel: namely, hydrogen.

While particular embodiments, materials, parameters, etc., have been illustrated and/or described, such are not intended to be limiting. Modifications and changes may become apparent to those skilled in the art, and it is intended that the invention be limited only by the scope of the appended claims.

The invention claimed is:

1. In a process for producing hydrogen by steam electrolysis using a steam electrolyzer having a cathode side and an anode side, the improvement comprising:

supplying natural gas to the anode side of the steam electrolyzer to reduce the consumption of electrical energy.

2. The improvement of claim 1, additionally including positioning an appropriate catalyst on the anode side to promote the partial oxidation of the natural gas to CO and hydrogen, thereby producing a gas mixture of CO and $H_2$.

3. The improvement of claim 2, additionally including shifting the CO to $CO_2$ to produce additional hydrogen.

4. The improvement of claim 1, additionally including varying the ratio between the natural gas and electricity inputs in response to fluctuations in relative costs of the natural gas and electricity.

5. The improvement of claim 1, wherein said steam electrolyzer comprises a membrane and the natural gas is used to burn out the oxygen resulting from electrolysis at the cathode side, thereby reducing or eliminating the potential difference across the electrolyzer membrane.

6. In a high temperature steam electrolyzer having an electrolyzer membrane, means for providing a gas on the cathode side of the membrane, means for providing a gas on the anode side of the membrane, and electrical means for heating the cathode side gas and the anode side gas, to produce hydrogen, the improvement comprising:

means for supplying natural gas to the anode gas side to burn out oxygen resulting from electrolysis, thereby reducing or eliminating the electrical potential difference across the electrolyzer membrane, thereby reducing the electrical consumption of the steam electrolyzer.

7. The improvement of claim 6, wherein the cathode side gas is composed of a mixture of steam and hydrogen.

8. The improvement of claim 6, wherein the anode side gas is composed of natural gas.

9. The improvement of claim 6, additionally including a catalyst on the anode side of the membrane.

10. The improvement of claim 9, wherein said catalyst is composed of material selected from the group consisting of Ni cermets, rhodium and ruthenium.

11. The improvement of claim 9, additionally including means to vary a ratio between electricity input and natural gas input on the anode side.

12. The improvement of claim 6, additionally including a mixed ionic-electronic conductor as an electrolyte.

13. The improvement of claim 12, wherein the mixed conductor is composed of material selected from the group consisting of doped-ceria, and the family (La, Sr)(Co, Fe, Mn) $O_3$.

14. A natural gas-assisted steam electrolyzer for producing hydrogen, including:

an electrolyzer membrane having a cathode side and an anode side, means for supplying a gas to the cathode side, means for supplying a gas to the anode side, means for supplying electrical energy to the cathode side and the anode side for heating the supplied gas, and means for supplying natural gas to the anode side.

15. The steam electrolyzer of claim 14, additionally including a catalyst on the anode side.

16. The steam electrolyzer of claim 15, wherein said catalyst is selected from the group consisting of Ni cermets rhodium and ruthenium.

17. The steam electrolyzer of claim 15, additionally including means for varying the electricity supply thereto and natural gas supplied to the anode side.

18. The natural gas-assisted steam electrolyzer of claim 14, additionally including an electrolyte composed of a mixed ionic-electronic conductor.

19. The natural gas-assisted steam electrolyzer of claim 18, wherein said mixed conductor is composed of material selected from the group consisting of doped-ceria and the family (La, Sr)(Co, Fe, Mn) $O_3$.

* * * * *